US007043893B2

(12) United States Patent
Stalder et al.

(10) Patent No.: US 7,043,893 B2
(45) Date of Patent: May 16, 2006

(54) DEVICE FOR PRODUCING A SPUN YARN

(75) Inventors: Herbert Stalder, Kollbrunn (CH); Peter Anderegg, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/486,038

(22) PCT Filed: Aug. 5, 2002

(86) PCT No.: PCT/CH02/00430

§ 371 (c)(1),
(2), (4) Date: Aug. 23, 2004

(87) PCT Pub. No.: WO03/014443

PCT Pub. Date: Feb. 20, 2003

(65) Prior Publication Data

US 2004/0261391 A1 Dec. 30, 2004

(30) Foreign Application Priority Data

Aug. 8, 2001 (CH) ..... 1462/01

(51) Int. Cl.
*D01H 4/02* (2006.01)

(52) U.S. Cl. ..... 57/315; 57/350

(58) Field of Classification Search ..... 57/315, 57/328, 333, 350

See application file for complete search history.

(56) References Cited

U.S. PATENT DOCUMENTS 5,528,895 A 6/1996 Deno
5,647,197 A 7/1997 Imamura
6,789,382 B1 * 9/2004 Stalder et al. ..... 57/333

FOREIGN PATENT DOCUMENTS

JP 2513582 6/1996

* cited by examiner

*Primary Examiner*—Shaun R Hurley
(74) *Attorney, Agent, or Firm*—Dority & Manning

(57) ABSTRACT

To manufacture a spun yarn from a loose fiber structure, devices are used in which a swirl chamber is provided between a fiber delivery channel and a yarn extraction channel. A fluid is blown into the swirl chamber. This device exhibits in the swirl chamber a guide surface, which delimits the swirl chamber downstream for the purpose of guiding fibers or fiber sectors that are swirling in the swirl chamber, the surface extending in collar fashion around the inlet aperture of the yarn extraction channel. The guide surface may form an angle of at least 30° with the axis of the yarn extraction channel in the yarn extraction direction, and outer areas of this guide surface are at a distance interval from the inlet aperture of the yarn extraction channel that corresponds to at least one tenth of the effective staple length of the fibers that are to be processed.

7 Claims, 2 Drawing Sheets

(state of the art)

DEVICE FOR PRODUCING A SPUN YARN

BACKGROUND OF THE INVENTION

The invention relates to a device for the manufacture of a spun yarn from a loose fibre structure with the aid of a swirl flow. The device serves to manufacture a spun yarn from a loose fibre structure conducted to the device, whereby the fibre structure is drawn through a swirl chamber in which the fibres are subjected to a swirling flow of a fluid in order to induce rotation, and are thereby spun into a yarn.

Spinning devices of the aforementioned type are known, for example, from the publications U.S. Pat. No. 5,528,895 or U.S. Pat. No. 5,647,197 (both Murata). Such devices exhibit a fibre delivery channel and a yarn extraction channel, whereby the outlet area of the fibre delivery channel is essentially aligned against the inlet area of the yarn extraction channel and the outlet aperture of the fibre delivery channel is arranged at a distance interval from the inlet aperture of the yarn extraction channel. The swirling flow is produced in the area of this distance interval. In the area of the outlet aperture of the fibre delivery channel, in addition, twist prevention means are provided (e.g., eccentric edge, over which the fibres are drawn, or in the essentially concentric pin, about which the fibres are conducted).

The inlet area of the yarn extraction channel usually has the form of a slender spindle, which rotates as appropriate, and which, like the swirling flow, can have the function of inducing rotation. An outlet channel with an essentially ring-shaped cross-section runs around the spindle. The outlet channel leads out of the cavity, equipped as a swirl chamber, and runs essentially parallel to the yarn extraction channel. The swirl chamber in this situation has essentially the same diameter as the inlet area of the outlet channel and is equipped with nozzles directed into the chamber for blowing in a fluid (e.g. air). The fluid which is blown into the swirl chamber is conducted away through the outlet channel, whereby the swirling flow produced in the swirl chamber continues around the yarn extraction channel (spindle) into the outlet channel. The swirl chamber and an inlet area of the outlet channel accordingly essentially represent a functional unit that serves to incur the rotation.

The cross-sections of the fibre delivery channel, the yarn extraction channel, and the outlet channel are small in comparison with an average fibre length. The length of the fibre delivery channel is designed in such a way that at least a part of the fibres is still being held in the inlet area of the fibre delivery channel (e.g., by the delivery rollers of a drafting device located upstream of the fibre delivery channel) even though the forward end of which has already reached the area of the yarn extraction channel.

Fibres that are conducted to a device such as that described briefly heretofore are, on the one hand, held in the fibre structure, and so conducted from the outlet aperture of the fibre delivery channel into the yarn extraction channel essentially without rotation. On the other hand, however, in the area between the fibre delivery channel and the yarn extraction channel, the fibres are subjected to the centrifugal effect of the swirling flow, as a result of which they, or at least their end sectors, are driven radially away from the inlet aperture of the yarn extraction channel. The yarns that are manufactured by the process described then also exhibit a core of fibres or fibre sectors running essentially in the longitudinal direction of the yarn without substantial rotation, and an outer area in which the fibres or fibre sectors are rotated around the core.

This yarn structure comes about, according to a model explanation, in that the forward ends of fibres, in particular of fibres of which the following sectors are still held upstream of the fibre delivery channel, essentially pass directly into the yarn extraction channel. The following fibre sectors, however, in particular once they are no longer being held in the inlet area of the fibre delivery channel, are drawn out of the fibre structure by the swirling effect and are then rotated to form the yarn. It may also arise that forward ends of fibres are splayed outwards from the fibre structure by the swirling effect, while the following end remains in the central area of the fibre structure, which leads to the loops observed in the corresponding yarns.

In any event, fibres are bound at the same time both in the yarn being formed, as a result of which they are drawn into the yarn extraction channel, as well as being subjected to the centrifugal effect, which accelerates them centrifugally, i.e., away from the inlet aperture of the yarn extraction channel, and draws them into the extraction channel. The fibre areas drawn by the swirling flow out of the fibre structure form a fibre swirl that opens into the inlet aperture of the yarn extraction channel. The longer portions of fibre swirl wind in spiral fashion outwards around the spindle-shaped inlet area of the yarn extraction channel and are drawn in this spiral (against the force of the swirl in the extraction channel) against the inlet aperture of the yarn extraction channel. Fibres of which the forwards or following end is not drawn into the yarn being formed are, with a degree of probability that is greater with smaller fibres, sucked through the outlet channel and, as a result, represent undesirable fibre waste.

The known spinning method described is characterized in that it allows for very high spinning speeds (up to ten times higher spinning speeds than for ring spinning methods). On the other hand, it has proved to be difficult with this method to avoid a high fibre wastage and to obtain sufficient fibre rotation in the rotated outer area of the yarn to produce high yarn quality.

OBJECTS AND SUMMARY OF THE INVENTION

It is, therefore, the principal object of the invention to propose changes related to the device with which the spinning method described heretofore can be improved. The invention, therefore, creates a device for spinning by means of a swirling flow with which higher yarn qualities are achievable than are possible with the known devices that serve the same purpose. In this situation, the fibre waste should be as small as possible, i.e. in any event not greater than is possible with known devices. Additional objects and advantages of the invention will be set forth in part in the following description, or may be obvious from the description, or may be learned through practice of the invention.

The invention is based on the idea of creating more rotation by increasing the swirling efficiency in the yarn, whereby the swirling efficiency is intended to be increased by the reduction of the friction between swirling fibre sectors and stationary parts of the device. The friction reductions striven for are realized in that a substantial part of the fibre swirl is not, in the known manner, guided at the radial limits of the swirl chamber and around a spindle-shaped inlet area of the yarn extraction channel in a way that causes friction. Instead, the fibre swirl is guided on a guide surface that extends around the inlet aperture of the yarn extraction channel and that forms an angle of more than 30° (preferably between 45° and 90°) around the yarn extraction channel towards its axis in the yarn extraction direction. The guide surface, therefore, extends in collar fashion around the inlet aperture of the yarn extraction channel. The outermost areas of the guide surface exhibit a distance interval from the inlet aperture of the yarn extraction channel that corresponds to at least a tenth of the effective staple length of the fibres that are to be processed, and preferably is greater than a sixth of the effective staple length.

The effective staple length referred to heretofore is calculated in accordance with the formula published in the Japanese utility model No. 2.513.582. It is somewhat greater than an average staple length determined with an almeter.

The guide surface of the device according to the invention represents preferably a truncated cone at the tip of which is arranged the inlet aperture of the yarn extraction channel. It has no rotation-inducing friction, i.e., it does not rotate. For this reason, it is also designed for the smallest possible fibre adherence and fibre friction respectively.

The improvements in the spinning process with regard to yarn quality and fibre waste that can be achieved with the device according to the invention in comparison with devices according to the state of the art are based on the following effect. The rotating fibre ends, which according to the state of the art are arranged around the spindle-shaped yarn extraction channel and which are drawn tight around this spindle in screw fashion by the extraction of the yarn, are arranged flatter in the device according to the invention, as a result of which the tightening effect and the fibre friction associated with this are avoided. At least a part of the surfaces, which radially delimit the fibre swirl and against which the fibres are pressed by the centrifugal force of the swirl flow, are further distant from the centre of the fibre swirl, and, as a result, create friction with only a smaller proportion of the swirling fibres than is the case in known devices.

The reduction of the forces with which fibres or fibre sectors are pressed against walls has the effect not only of reducing the friction but also of creating a more voluminous arrangement of the fibres in the fibre swirl. In this more voluminous fibre structure, there is a greater probability than in devices of the state of the art that freely-swirling fibres (without binding in the yarn being formed) are retained in the fibre structure and are guided to the yarn instead of being driven into the outlet channel.

The friction-reducing effect of the guide surface of the device according to the invention can be increased still further if it is provided with a surface structure (e.g., orange skin or orange peel like surface), which is suitable for reducing the fibre friction still further.

Embodiment examples of the device according to the invention for the manufacture of a spun yarn from a loose fibre structure with the aid of a swirling flow are described in detail on the basis of the following figures.

DETAILED DESCRIPTION

Reference will now be made in detail to the presently preferred embodiments of the invention, one or more examples of which are shown in the figures. Each example is provided to explain the invention and not as a limitation of the invention. In fact, features illustrated or described as part of one embodiment can be used with another embodiment to yield still a further embodiment. It is intended that the present invention cover such modifications and variations.

Figure 1:
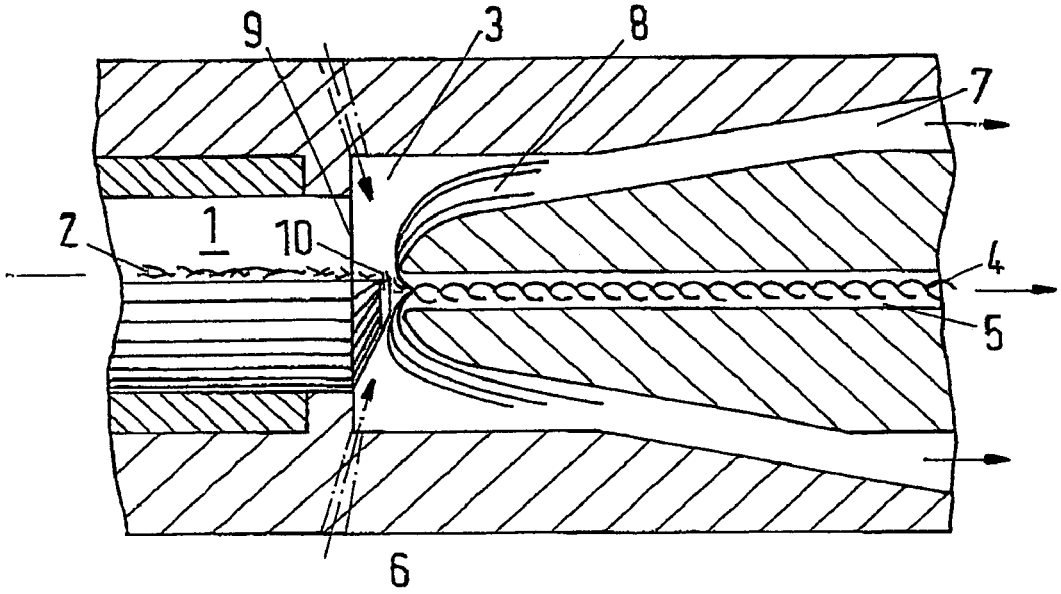
FIG. 1 shows a cross-sectional view of the outlet area of the fibre delivery channel and the inlet area of the yarn extraction channel (swirl chamber area) of a device according to the state of the art for the manufacture of a spun yarn from a loose fibre structure by means of a swirling flow (section)

FIG. 1 shows the swirl chamber area according to the state of the art, with which a rotation is applied to a loose fibre structure 2 being delivered through a fibre delivery channel 1 into a swirl chamber 3, so that a spun yarn 4 is formed, which is drawn off through a yarn extraction channel 5. The swirl flow is created in the swirl chamber 3 by blowing in a fluid, e.g., air, through nozzles 6 opening tangentially into the chamber. The fluid is guided off through an outlet channel 7, whereby the outlet channel 7 exhibits a ring-shaped cross-section arranged around the yarn extraction channel 5. The outlet channel's inlet area has essentially the same diameter as the swirl chamber 3, so that the swirl flow created in the swirl chamber is also continued in the outlet channel. Fibre sections 8 released from the fibre structure by the centrifugal effect of the swirl flow are located in the outlet channel 7 in spiral fashion on the outside around the stationary or rotating spindle-shaped inlet area of the yarn extraction channel 5. The swirl chamber 3 and inlet area of the outlet channel 7 represent one functional unit.

Arranged at the outlet aperture 9 of the fibre delivery channel 1 in the embodiment shown is an edge 10, serving as a rotation stopping means, which is arranged eccentrically to the yarn extraction channel 5. The principle is also known of using a pin arranged essentially concentrically to the yarn extraction channel as a rotation stopping means, said pin representing a temporary yarn core.

The diameter of the swirl chamber 3 and of the inlet area of the outlet channel 7 corresponds in the embodiment shown to about 15 to 20% of the effective staple length of the fibres that are to be processed. This means that a large part of the fibre sections moved in the fibre swirl 8 rub against the outer walls of the swirl chamber 3 and the outlet channel 7, aligned perpendicular to the centrifugal force. In the outlet channel 7, the swirling fibre sectors 8 are brought increasingly in contact in spiral fashion with the inner wall of the outlet channel 7 (outer wall of the yarn extraction channel 5) due to the effect of the yarn intake, and are even drawn tight in screw fashion, which in turn creates friction.

Figure 2:
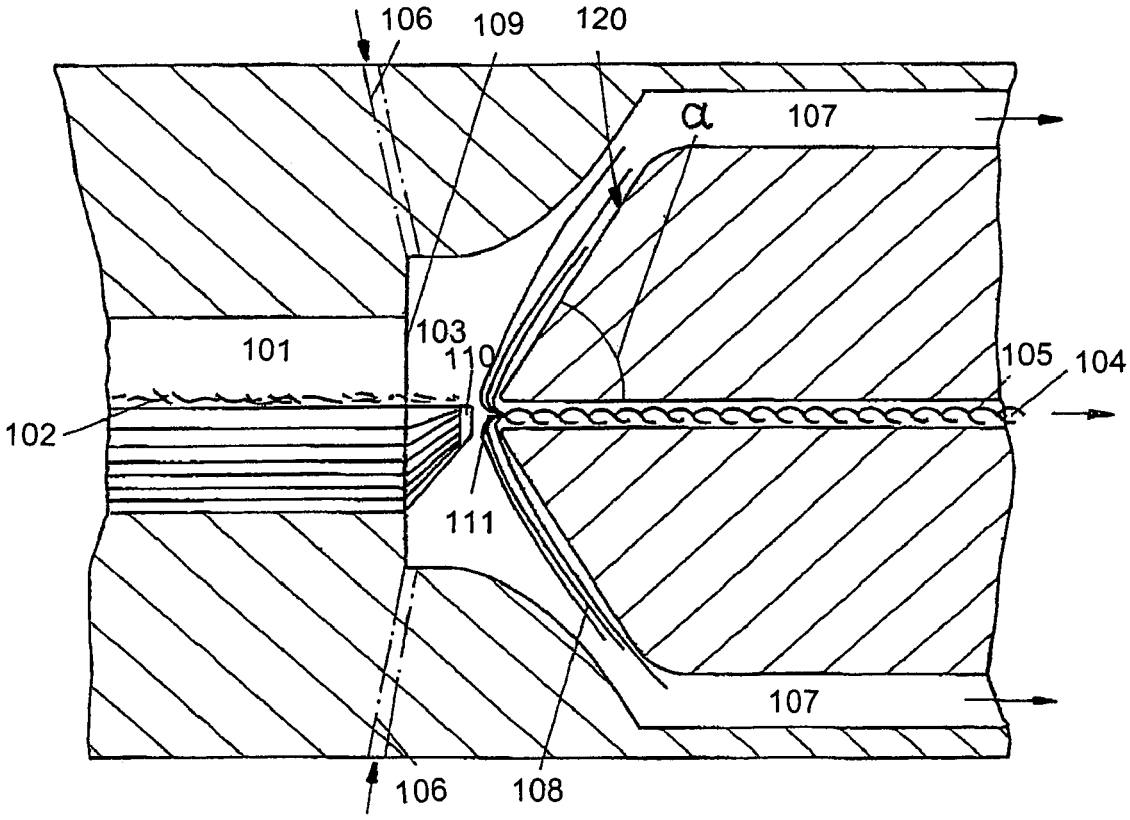
FIG. 2 shows a cross-sectional representation of a swirl chamber area of an embodiment example of a device according to the invention.

FIG. 2 shows a first embodiment example of the device according to the invention. As in FIG. 1, only the area of the swirl chamber 103 is represented, i.e., the outlet area of the fibre delivery channel 101 with the outlet aperture 109 and rotation stop means 110 and the inlet area of the yarn extraction channel 105 with inlet aperture 111, as well as the swirl chamber 103 and outlet channel 107, which, as in FIG. 1, exhibits an essentially ring-shaped cross-section.

The swirl chamber 103 of the embodiment represented in FIG. 2 exhibits a guide surface 120, which delimits the swirl chamber 103 downstream and forms an angle $\alpha$ of at least 30°, advantageously between 45° and 90°, with the axis of the yarn extraction channel 105. The guide surface 120 extends in collar fashion around the inlet aperture 111 of the yarn extraction channel 105 and forms preferably a truncated cone, at the tip of which is arranged the inlet aperture 111 of the yarn extraction channel 105. The radial extension of the guide surface 120 is at least as large as a tenth, and preferably larger than a sixth, of the effective staple length of the fibres that are to be processed. The outlet channel 107 connects on the outside to the guide surface 120 and exhibits at least in this area a ring-shaped cross-section, which is perceptibly larger in comparison with the state of the art. The delimitation of the swirl chamber 103 upstream runs preferably at least in part approximately parallel to the guide surface 120.

The guide surface 120 has no rotation inducing function. This means that it is stationary, as is the yarn extraction channel 105. The inducement of rotation is effected only by the swirl flow.

The nozzles 106, through which, in order to create the swirl flow, a fluid is pressed in a tangential direction into the swirl chamber 103, are advantageously arranged somewhat upstream of the inlet aperture 111 of the yarn extraction channel 105, and are distributed about this in a regular fashion. Their radial position is preferably relatively close to the axis of the yarn extraction channel 105, advantageously closer than the radial position of the outermost guide surface areas, as is represented in FIG. 2.

As a result of the radial enlargement of the swirl chamber and the inlet area of the outlet channel in relation to the state of the art, the fibre friction at the walls perpendicular to the centrifugal force of the swirl flow is reduced. The swirling fibre sectors 108 can also no longer be drawn tight due to the intake of the yarn, with the result that less fibre friction occurs at the guide surface than is the case at the slim spindle of the yarn extraction channel 105 of the known devices. Fibre friction at the guide surface can be further reduced by the fact that this is provided in an inherently known manner with a corresponding surface structure. As a result of the friction reductions brought about in this manner, the swirling fibre areas are rotated with greater efficiency than is the case in devices according to the state of the art.

Figure 3:
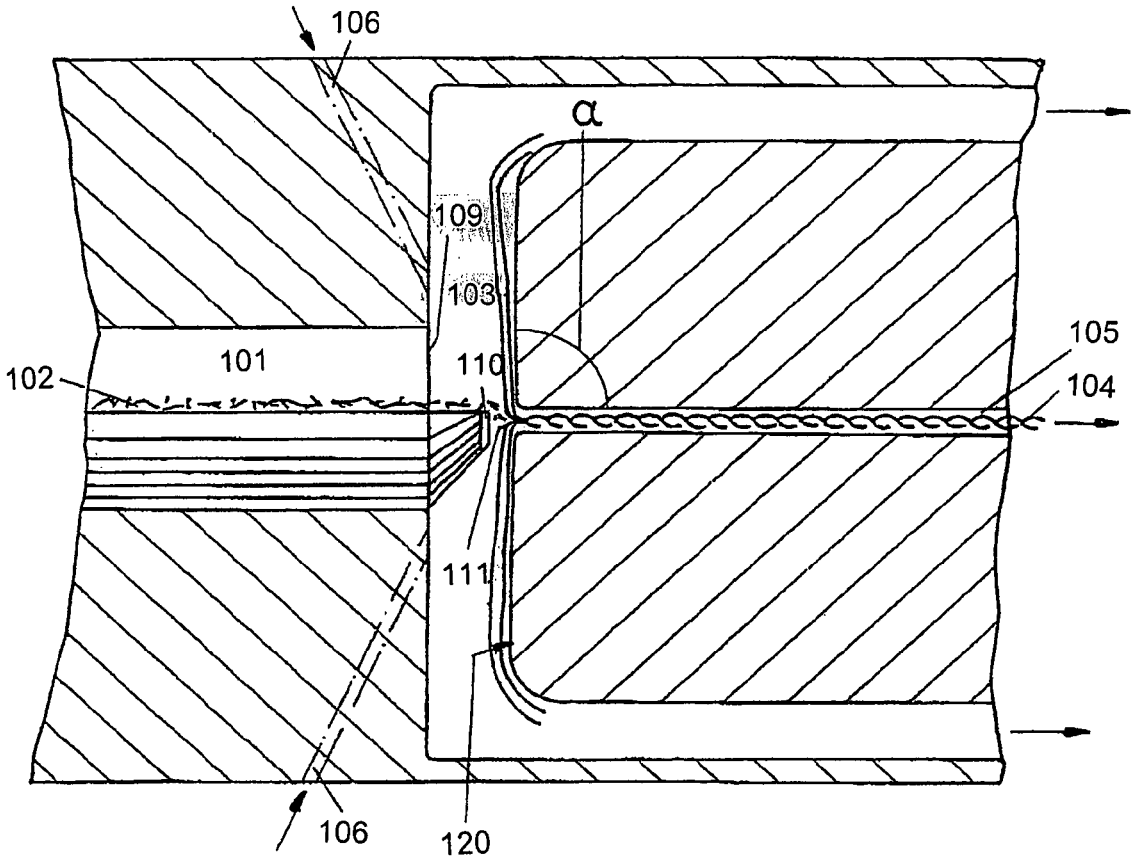
FIG. 3 shows a cross-sectional representation of a swirl chamber area of another embodiment example of a device according to the invention.

FIG. 3 shows a further embodiment example of the device according to the invention, whereby the manner of representation is the same as in FIGS. 1 and 2. The same parts are also designated with the same reference numbers as FIG. 2.

The embodiment in FIG. 3 differs from that in FIG. 2 essentially only by the angle $\alpha$, which in this case amounts to 90°, so that the guide surface 120 is aligned essentially perpendicular to the yarn extraction channel 105. The swirl chamber 103 is essentially of the shape of a circular disk.

The radial extension of the guide surface 120 and the angle $\alpha$ of the guide surface 120 to the axis of the yarn extraction channel 105, as well as its matching to the swirl flow that is to be created, is to be determined empirically for different spinning processes, in particular for the spinning of different fibre materials.

It will be appreciated by those skilled on the art that various modifications and variations can be made in the present invention without departing from the scope or spirit of the invention. It is intended that the present invention include such modifications and variations.

The invention claimed is:

1. A device for spinning a yarn from a loose fibre structure with the aid of a swirl flow, said device comprising:

a fibre delivery channel through which fibres of said loose fibre structure travel, said fibre delivery channel defining an outlet aperture;

a yarn extraction channel defining an inlet aperture positioned at a known distance from said outlet aperture of said fibre delivery channel, said yarn extraction channel receiving said yarn through said inlet aperture as said yarn is being spun;

a swirl chamber arranged between said outlet aperture of said delivery channel and said inlet aperture of said yarn extraction channel, said swirl chamber receiving a fluid that creates a swirl flow within said swirl chamber;

at least two nozzles disposed tangentially to said swirl chamber, said nozzles feeding said fluid to said swirl chamber to create said swirl flow;

an outlet channel disposed to said swirl chamber for conducting said fluid out of said swirl chamber, said outlet channel forming an anular cross-section; and a guide surface radially extending in a collar fashion around said inlet aperture of said yarn extraction channel and connecting to said outlet channel so that said guide surface forms an angle with an axis of said yarn extraction channel in a direction of yarn travel, said guide surface having a radial extension from said inlet aperture to said outlet channel of at least one-tenth of an effective staple length of the fibres to be processed and delimiting the swirl chamber downstream to guide fibres or fibre sections swirling in said swirl flow.

2. A device as in claim 1, wherein said guide surface has a radial extension from said inlet aperture of said yarn extraction channel to said outlet channel of greater than one-sixth of the effective staple length of the fibres to be processed.

3. A device for spinning a yarn from a loose fibre structure with the aid of a swirl flow, said device comprising:

a fibre delivery channel through which fibres of said loose fibre structure travel, said fibre delivery channel defining an outlet aperture;

a yarn extraction channel defining an inlet aperture positioned at a known distance from said outlet aperture of said fibre delivery channel, said yarn extraction channel receiving said yarn through said inlet aperture as said yarn is being spun;

a swirl chamber arranged between said outlet aperture of said delivery channel and said inlet aperture of said yarn extraction channel, said swirl chamber receiving a fluid that creates a swirl flow within said swirl chamber;

at least two nozzles disposed tangentially to said swirl chamber, said nozzles feeding said fluid to said swirl chamber to create said swirl flow;

an outlet channel disposed to said swirl chamber for conducting said fluid out of said swirl chamber, said outlet channel forming an anular cross-section;

a guide surface radially extending in a collar fashion around said inlet aperture of said yarn extraction channel and connecting to said outlet channel so that said guide surface forms an angle with an axis of said yarn extraction channel in a direction of yarn travel, said guide surface having a radial extension from said inlet aperture to said outlet channel of at least one-tenth of an effective staple length of the fibres to be processed and delimiting the swirl chamber downstream to guide fibres or fibre sections swirling in said swirl flow; and wherein said angle defined by said guide surface and said axis of said yarn extraction channel is at least 30°.

4. A device as in claim 3, wherein said angle defined by said guide surface and said axis of said yarn extraction channel is between 45° and 90°.

5. A device as in claim 1, wherein said guide surface comprises a surface structure that reduces fibre friction.

6. A device as in claim 1, wherein a wall of said swirl chamber opposite said guide surface is about parallel to said guide surface.

7. A device as in claim 1, wherein said nozzles are arranged in closer proximity to said axis of said yarn extraction channel than at such outermost areas where said guide surface connects to said outlet channel.

* * * * *